US007011140B1

(12) United States Patent
Yu et al.

(10) Patent No.: US 7,011,140 B1
(45) Date of Patent: Mar. 14, 2006

(54) GAS ENHANCED CONTROLLED COOLING INGOT MOLD

(75) Inventors: Ho Yu, Murrysville, PA (US); David D. Leon, Murrysville, PA (US); Allen M. Hummel, Cranberry Township, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/977,006

(22) Filed: Oct. 28, 2004

(51) Int. Cl.
*B22D 11/124* (2006.01)

(52) U.S. Cl. ..... 164/487; 164/444

(58) Field of Classification Search ..... 164/487, 164/444
See application file for complete search history.

(56) References Cited

U.S. PATENT DOCUMENTS

| | | | | |
|---|---|---|---|---|
| 4,474,225 | A | 10/1984 | Yu | 164/467 |
| 4,693,298 | A | 9/1987 | Wagstaff | 164/486 |
| 5,040,595 | A * | 8/1991 | Wagstaff | 164/487 |
| 5,112,412 | A | 5/1992 | Plata et al. | 148/688 |
| 5,413,314 | A | 5/1995 | Plata et al. | 266/113 |
| 5,623,323 | A | 4/1997 | Johnson et al. | 351/219 |
| 6,470,959 | B1 | 10/2002 | Desrosiers et al. | 164/481 |
| 6,605,250 | B1 | 8/2003 | Reiso et al. | 266/114 |

* cited by examiner

*Primary Examiner*—Kuang Y. Lin
(74) *Attorney, Agent, or Firm*—Eckert Seamans Cherin & Mellott, LLC

(57) ABSTRACT

A cooling mechanism for a casting apparatus having a mold that includes sides, a bottom, and a top defining a cavity. The cooling mechanism allows for simultaneous injection of liquid and gas onto a cast ingot therefore providing a lower minimum operation liquid flow rate, while maintaining a fairly constant coolant impingement location on the ingot surface. As a result, heat is extracted from the metal ingot at a much lower rate allowing the ingot to experience superior startup butt curl control, which substantially reduces the number of localized stresses that can lead to cracking of the ingot. Reducing the number of cracks in the ingot substantially reduces the number of wasted ingots, therefore improving efficiency and reducing costs. A method of casting is also disclosed.

29 Claims, 2 Drawing Sheets

GAS ENHANCED CONTROLLED COOLING INGOT MOLD

FIELD OF THE INVENTION

The invention relates to the continuous, expressly including, but not limited to, semi-continuous casting of metal ingots by direct cooling, and in particular, to a mechanism and method for controlling the rate at which the metal ingot is directly cooled in the casting operation.

BACKGROUND OF THE INVENTION

Metals are commonly cast as ingots by pouring molten metal into one end opening of an open ended mold while the resulting body of partially solidified metal or ingot is advanced from the opposing end of the mold on a stool or support which is reciprocated in relation to the mold. To cast successfully, however, the operator must closely control the temperature of the metal, and this is accomplished by cooling the mold itself, and directing liquid coolant against the surface of the metal ingot as it emerges from the mold. The rate at which heat is extracted from the metal by the latter operation is a function of the temperature of the coolant itself, and the velocity of the coolant flow. For any given piece of molding equipment, the velocity is largely a function of the rate at which the coolant is discharged onto the ingot.

The ingot cooling rate at the start of the ingot drop is significantly higher than that when the ingot has reached thermal steady-state. At the start of the drop, both the support and the ingot cooling water chill the ingot butt. The rapid chilling of the ingot butt generates excessive thermal stress, which results in ingot butt deformation, such as butt curl. The severity of the ingot butt deformation is particularly apparent in ingots with a high width to thickness ratio, such as ingots having a width of approximately 1016–1829 mm (40–72 in.) and a thickness of approximately 508–660 mm (20–26 in.).

Butt curl is a problem primarily because it causes a portion of the ingot butt to lose contact with the bottom block at the start of the ingot drop. If this occurs for too long a time, molten metal in the ingot head crater may melt through the rising bottom and result in metal breakout or cracking. Likewise, if the curl rises faster than the lowering rate of the ingot, the molten metal may spill through the gap between the ingot and the mold, causing a yo-out. In addition, butt curl is an impediment to implementation of a start low-run low DC ingot casting practice, which can achieve improved ingot surface and increased casting rate.

It is known to one of ordinary skill in the casting art that ingot butt curl can be reduced by decreasing the ingot surface cooling during startup through low mold liquid application (e.g. less than about 0.4 gpm per inch mold perimeter). To minimize the coolant heat transfer rate on the ingot surface, mold liquid has to be run at an even lower flow rate (e.g. about 0.04 gpm per inch mold perimeter).

In a commercial single jet mold such a turn down of liquid flow is very difficult to implement. The liquid impingement location on the ingot surface of a commercial single jet mold would drift downward or fail to contact the ingot surface all together as the mold liquid flow rate is lowered. This would inhibit ingot cooling and cause it to bleed out. There are dual liquid coolant jet molds in the market place that would allow one of the jets to operate a low liquid mold. However, the degree of low water is still somewhat limited.

It is therefore a primary object of the present invention to provide a commercial single jet mold design for casting of metal ingots that has a lower minimum operation liquid flow rate while maintaining a constant liquid impingement location on the ingot surface, therefore creating superior ingot startup buff curl control and a lower than normal coolant heat transfer rate on the ingot surface.

Another object of the instant invention is to provide a commercial single jet mold design for the casting of metal ingots that substantially reduces the occurrence of ingot cracking due to inadequate ingot startup butt curl control and an abrupt change in the coolant heat transfer rate when cooling liquid is ramped from startup to steady state.

A further object of this invention is to provide a method for casting metal ingots with improved surface quality without the need for having multiple liquid coolant jets.

These and other objects and advantages are met or exceeded by the instant invention, and will become more fully understood and appreciated with reference to the following description.

SUMMARY OF THE INVENTION

The invention relates to a cooling mechanism for a casting apparatus used in casting molten metal alloys. The casting apparatus comprises a mold having a top portion defining a cavity, sides, and a bottom portion. The cooling mechanism directly cools a cast ingot through simultaneous injection of liquid and gas into the cavity of the mold and comprises a cooling reservoir for holding a liquid, a gas passageway that is coupled to and runs substantially parallel to the bottom of the mold and has a gas slot at an end closest to the cavity, and a liquid slot having a first end coupled to the cooling reservoir and a second end structured for insertion within the gas slot.

The cooling mechanism allows for a larger than normal liquid flow rate turn down ratio (maximum operation liquid flow rate/minimum operation liquid flow rate). Specifically, it provides a lower minimum operation liquid flow rate, while maintaining a fairly constant coolant impingement location on the ingot surface. This allows the cooling mechanism to provide the high liquid flow rate (at least about 2 gpm per inch of mold perimeter) needed for steady state casting and also the low liquid flow rate (less than about 0.04 gpm per inch of mold perimeter) needed for ingot casting startup butt curl control. As a result, heat is extracted from the metal ingot at a much lower rate allowing the ingot to experience superior startup butt curl control, which substantially reduces the number of localized stresses that can lead to cracking of the ingot. Reducing the number of cracks in the ingot substantially reduces the number of wasted ingots, therefore improving efficiency and reducing costs.

DETAILED DESCRIPTION OF PREFERRED EMBODIMENTS

The invention relates to a cooling mechanism for a casting apparatus used in casting molten metal alloys. The cooling mechanism directly cools a cast ingot through simultaneous injection of liquid and gas into the cavity of the mold. Simultaneous injection of liquid and gas by the cooling mechanism provides a lower minimum operation liquid flow rate, while maintaining a fairly constant coolant impingement location on the molten metal alloy.

For convenience, the present invention is described as having one gas passageway and slot and one liquid slot, however the invention includes two gas passageways and slots and two liquid slots. The passageways and slots are located directly across from each other, both being adjacent to a side of the solidifying ingot.

Figure 1:
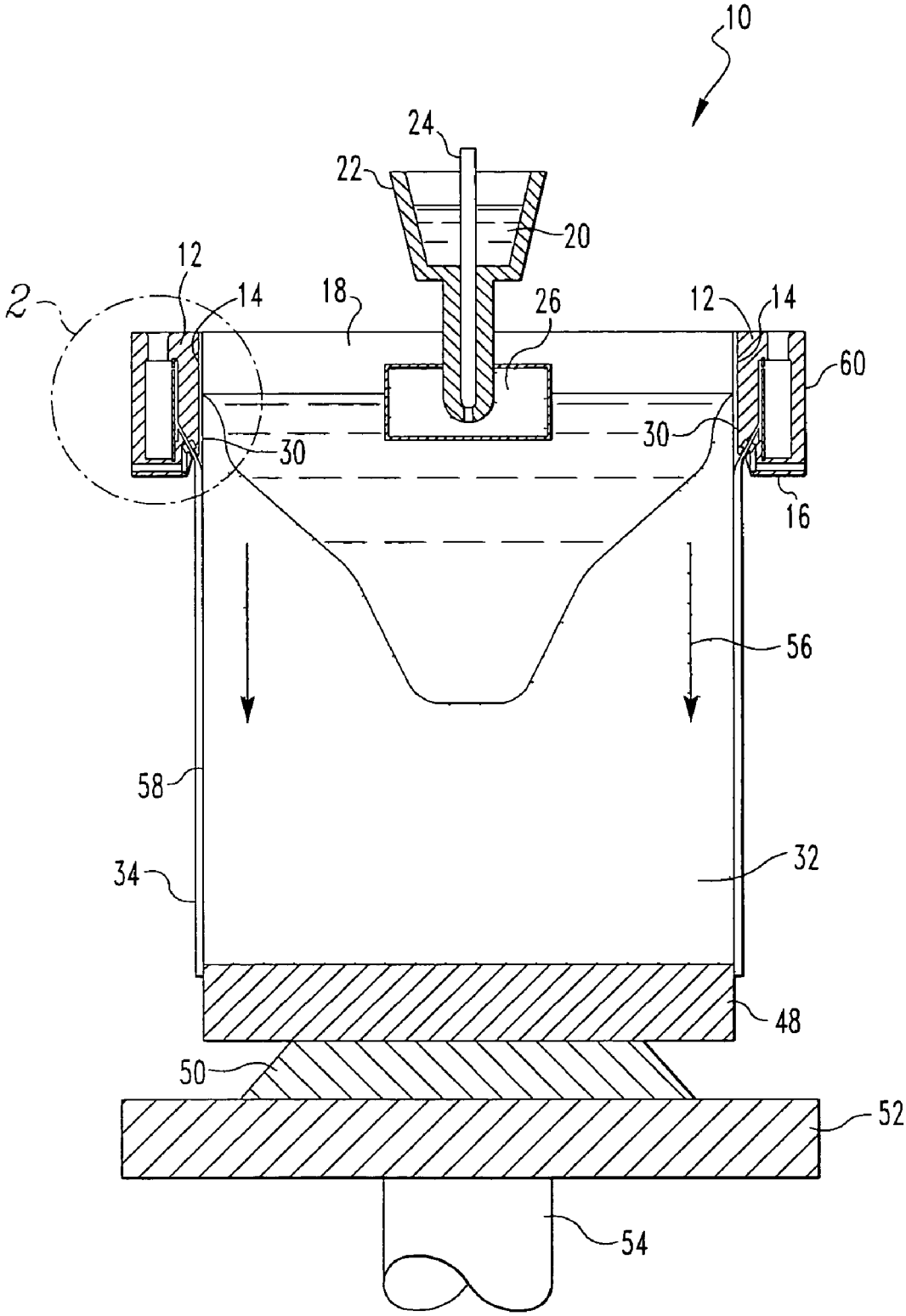
FIG. 1 is a perspective view of a casting apparatus incorporating the cooling mechanism of the present invention.

FIG. 1 shows a cross-sectional view of a casting apparatus 10 incorporating the cooling mechanism (FIG. 2) of the present invention. The casting apparatus 10 includes a mold 12 having sides 14, a bottom 16, and a top defining a cavity 18. Molten metal 20 is held in a trough 22. A furnace (not shown) supplies the trough 22 with molten metal 20. A control pin 24 activates and deactivates the flow of molten metal 20 into a distributor bag 26, which distributes the molten metal into the cavity 18.

Figure 2:
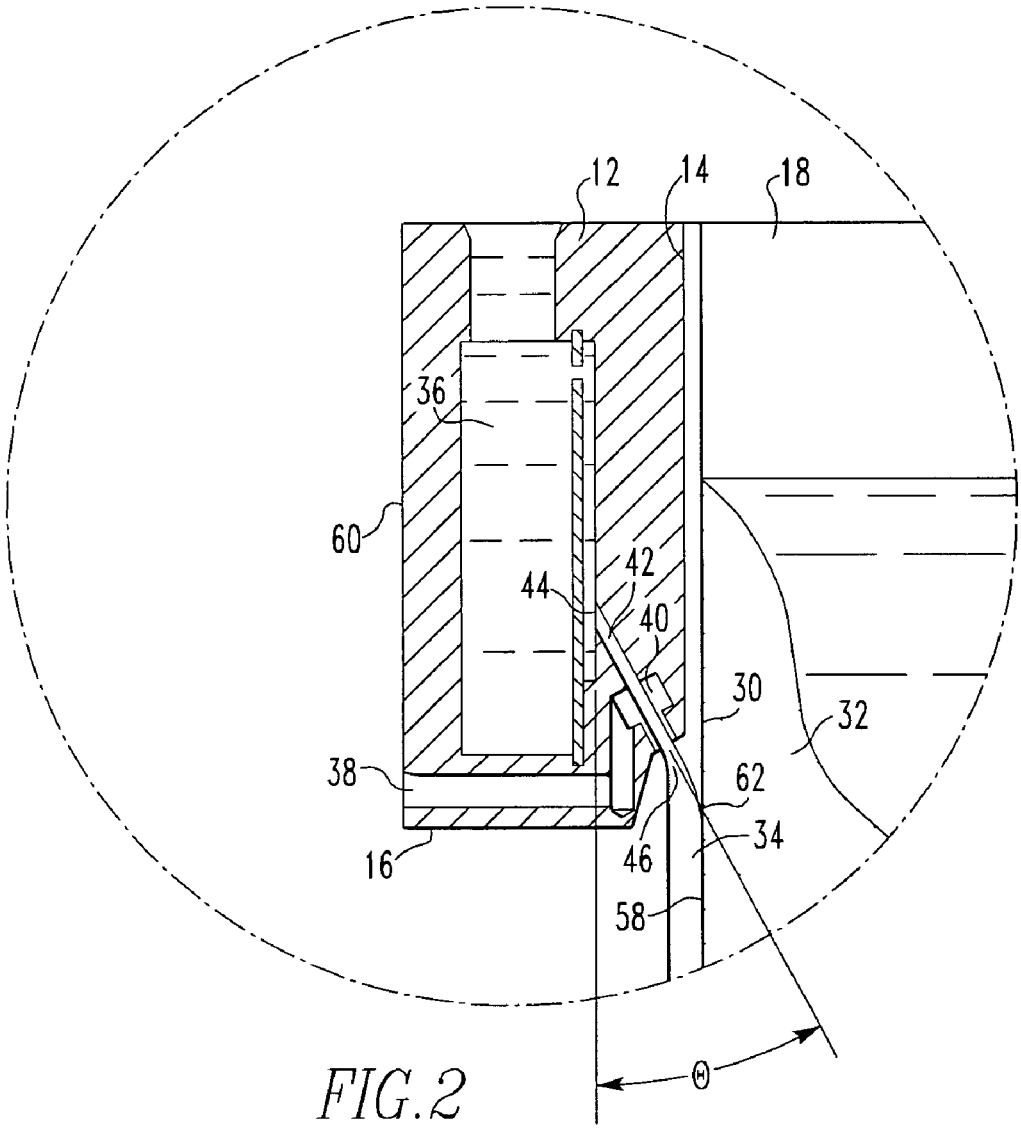
FIG. 2 is an enlarged view of the cooling mechanism of the present invention.

The inner wall 30 of the mold 12 is cooled by a cooling mechanism (FIG. 2). The cooling mechanism (FIG. 2) also directly cools a cast ingot surface 32 through simultaneous injection of liquid 34 and gas (not shown). The cooling mechanism (FIG. 2) includes a cooling reservoir 36 for holding a liquid, a gas passageway 38 having a slot 40, and a liquid slot 42. The gas passageway 38, which has a slot 40 at an end closest to the cavity 18, is coupled to and runs substantially parallel to the bottom 16 of the mold 12. The liquid slot 42 has a first end 44 coupled to the container 36 and a second end 46 structured for insertion within the gas slot 40. The liquid and gas slots (42, 40) are each concentric. Coupling mechanisms, such as retaining screws (not shown), can be used to secure both the gas passageway 38 to the mold 12 and the first end 44 of the liquid slot 42 to the cooling reservoir 36. The retaining screws are preferably aluminum or steel material, but may be comprised of any metal or metal alloy that does not soften at aluminum alloy melt casting temperatures. The diameter of the liquid slot 42 and gas passageway 38 are at least about 5/32 inch and 6/32 inch, respectively. As shown in FIG. 2 by the designation Θ, representing the angle of the liquid and gas slots (42,40) with respect to the cooling reservoir 36, the slots are preferably angled at an angle, Θ, of between about 15°–30°. For the casting of aluminum and aluminum alloys, the mold 12 and cooling mechanism (FIG. 2), including the cooling reservoir 36, liquid slot 42, and gas passageway 38, are of an aluminum metal or an aluminum alloy. However, it will be appreciated that they may be comprised of any known or suitable metal, metal alloy, or non-metal that does not soften at aluminum alloy melt casting temperatures.

During the casting process, the molten metal 20, in the trough 22, is dispersed into the cavity 18 of the mold 12 and the sides 14 of the mold 12 are contacted directly with liquid coolant 34. Due to the direct contact with the mold 12, the molten metal 20 solidifies into a solidified ingot 58. The solidified ingot 58 rests on a starting block 48. The starting block 48 rests on a starting block holder 50. The starting block holder 50 is attached to a platen 52. The platen 52 can be lowered or raised by a cylinder ram 54. As molten metal 20 in the cavity 18 solidifies into a solidified ingot 58, the cylinder ram 54 is lowered, which causes the solidified ingot 58 to also be lowered according to the directional arrows 56 superimposed onto the schematic cross section of the casting apparatus 10. As the cylinder ram 54 and solidified ingot 58 are lowered, the solidified ingot 58 is contacted directly with liquid coolant 34. The liquid 34 flows from a liquid pump (not shown) that is connected to the outer wall 60 of the mold 12, through the container 36, into the liquid slot 42, and out onto the ingot surface 32. The liquid 34 is preferably water, but could be of any liquid, or liquid/gas mixture, suitable for the purpose of cooling the ingot.

At the start-up of casting, the liquid flow rate is normally about 0.4 gallons/minute/inch. The invention reduces the liquid flow rate at this time to about 0.04 gallons/minute/inch. However, at this rate, the liquid stream would not have enough momentum to reach the desired constant ingot impingement location 62 of about 1 inch from the bottom 16 of the mold 12 (best represented in FIG. 2). This would lose ingot cooling and cause it to bleed out.

Therefore, gas flow is turned on and is set at a rate, at least 1 scfm/inch (standard cubic foot per minute/inch) perimeter of mold, so that sufficient momentum is transferred to the liquid stream 34 to assist it to reach the desired constant impingement location 62 on the ingot surface 32. As casting proceeds towards steady state, liquid flow 34 is gradually increased while gas flow is gradually decreased. At steady state casting, liquid flow 34 would be at a maximum rate of at least about 2 gal/min/in and gas flow would be less than about 1 scfm/inch (standard cubic foot per minute/inch) perimeter of mold. The gas flows from a gas compressor (not shown) that is also connected to the outer side 60 of the mold 12, through the gas passage 38, into the gas slot 40, and out onto the ingot surface 32. The gas is preferably air, but could be of any gas suitable for the purpose of carrying the liquid to an impingement location on the side of the ingot.

Having a constant liquid impingement location on the ingot surface 32 even at a low liquid flow rate maintains ingot cooling, prevents ingot bleedout, and reduces stresses on the ingot 58 that could lead to cracking. Without the presence of gas to provide momentum to the low liquid flow, the liquid coolant would likely fail to impinge the ingot surface. However, the gas provides the liquid with enough momentum to maintain, throughout the casting process, a constant impingement location 62 on the side of the ingot. Since the cooling mechanism (FIG. 2) of the present invention is equipped to handle a lower than normal liquid flow rate (e.g., less than about 0.4 gal/min/in) at start-up casting, and still maintain a constant liquid impingement location 62, a lower than normal heat transfer rate is obtained. The normal heat transfer rate from startup to steady state casting ranges from between about 10,000 BTU/hr/sq ft of area-1,000,000 BTU/hr/sq ft of area. The range in heat transfer rate from startup to steady state casting for this present invention is improved to between about 1,000 BTU/hr/sq ft of area-1,000,000 BTU/hr/sq ft of area. The capability of such low heat transfer rate at the start of the cast minimizes ingot butt curl. In addition, the gradual change from low to high in cooling rate reduces localized stresses that lead to cracking in crack sensitive alloy ingots.

Having described the presently preferred embodiments, it is to be understood that the invention may be otherwise embodied within the scope of the appended claims.

What is claimed is:

1. A cooling mechanism for a casting apparatus, said casting apparatus including a mold having sides, a bottom, and a top defining a cavity, said cooling mechanism for direct cooling a cast ingot through simultaneous injection of liquid and gas into said cavity, said cooling mechanism comprising:

a cooling reservoir for holding a liquid;

a gas passageway, said gas passageway coupled to and running substantially parallel to said bottom of said mold, said gas passageways having a gas slot at an end closest to said cavity; and a liquid slot, said liquid slot having a first end coupled to said cooling reservoir and a second end structured for insertion within said gas slot.

2. The cooling mechanism of claim 1 further including said second end of said liquid slot fitted within said gas slot.

3. The cooling mechanism of claim 1 wherein said gas slots and said liquid slots are each concentric.

4. The cooling mechanism of claim 1 wherein said liquid slots comprise a material consisting essentially of an aluminum alloy, a ferrous alloy, a copper alloy, and a ceramic material.

5. The cooling mechanism of claim 1 wherein said liquid slots have a diameter of at least about 5/32 inch.

6. The cooling mechanism of claim 1 wherein said liquid slot forms an angle θ with respect to said cooling reservoir.

7. The cooling mechanism of claim 6 wherein said angle O is between about 15°–30°.

8. The cooling mechanism of claim 1 wherein said gas passageways comprise material consisting essentially of aluminum alloy, ferrous alloy, copper alloy, and ceramic material.

9. The cooling mechanism of claim 1 wherein said gas passageways have a diameter of at least about 6/32 inch.

10. The cooling mechanism of claim 1 wherein said gas passageways form an angle θ with respect to said cooling reservoir.

11. The cooling mechanism of claim 10 wherein said angle θ is between about 15°–30°.

12. A casting apparatus for casting molten metal alloys, said casting apparatus including a mold comprising:

a top portion defining a cavity, a bottom portion, side portions, and a cooling mechanism for direct cooling a cast ingot through simultaneous injection of liquid and gas into said cavity, said cooling mechanism comprising a cooling reservoir for holding a liquid, a gas passageway, said gas passageway coupled to and running substantially parallel to said bottom of said mold, said gas passageway having a gas slot at an end closest to said cavity, and a liquid slot, said liquid slot having a first end coupled to said container for holding liquid and a second end structured for insertion within said gas slot.

13. The casting apparatus of claim 12 further including said second end of said liquid slot fitted within said gas slot.

14. The casting apparatus of claim 12 wherein said gas slots and said liquid slots are each concentric.

15. The casting apparatus of claim 12 wherein said liquid slots comprise a material consisting essentially of an aluminum alloy, a ferrous alloy, a copper alloy, and a ceramic material.

16. The casting apparatus of claim 12 wherein said liquid slots have a diameter of at least about 5/32 inch.

17. The casting apparatus of claim 12 wherein said liquid slots form an angle θ with respect to said cooling reservoir.

18. The casting apparatus of claim 12 wherein said angle θ is between about 15°–30°.

19. The casting apparatus of claim 12 wherein said gas passageways comprise material consisting essentially of aluminum alloy, ferrous alloy, copper alloy, and ceramic material.

20. The casting apparatus of claim 12 wherein said gas passageways have a diameter of at least about 6/32 inch.

21. The casting apparatus of claim 12 wherein said gas passageways form an angle θ with respect to said cooling reservoir.

22. The casting apparatus of claim 12 wherein said angle θ is between about 15°–30°.

23. A method of casting molten metal alloys comprising:

a casting apparatus including a mold having sides, a bottom portion, a top portion defining a cavity, and a cooling mechanism for direct cooling a cast ingot through simultaneous injection of liquid and gas into said cavity, said cooling mechanism comprising a cooling reservoir for holding a liquid, a gas passageway, said gas passageway coupled to and running substantially parallel to said bottom of said mold, said gas passageway having a gas slot at an end closest to said cavity, and a liquid slot, said liquid slot having a first end coupled to said cooling reservoir and a second end structured for insertion within said gas slot;

introducing molten metal to be cast into said cavity of said mold;

introducing said liquid into said liquid slot;

solidification of said molten metal into a solidified ingot as said liquid contacts said sides of said mold;

lowering of said solidified ingot from said cavity of said mold;

introducing said gas into said gas passageway, said gas flowing into said gas slot and providing said liquid with momentum to reach the impingement location on said solidified ingot;

removal of said solidified ingot from said mold cavity.

24. The method of claim 23 wherein said liquid flow rate is at least about 0.04 gal/min/in at the beginning of casting and increases to at least about 2 gal/min/in at the point at which the casting reaches steady state.

25. The method of claim 23 wherein said gas flow rate is at least about 1 scfm/inch perimeter of mold at the beginning of casting to less than about 1 scfm/in/perimeter of mold at steady state casting.

26. The method of claim 23 wherein said impingement location is disposed proximate said bottom of said mold.

27. The method of claim 26 wherein said impingement location is disposed about 1 inch below said bottom of said mold and wherein said impingement location remains constant throughout casting.

28. The method of claim 23 wherein said step of introducing liquid includes supplying water as said liquid.

29. The method of claim 23 wherein said step of introducing gas includes supplying air as said gas.

* * * * *